US008585840B2

(12) United States Patent
Miller et al.

(10) Patent No.: US 8,585,840 B2
(45) Date of Patent: Nov. 19, 2013

(54) RECOVERY OF THE ENERGETIC COMPONENT FROM PLASTIC BONDED EXPLOSIVES

(75) Inventors: Paul L. Miller, Harvest, AL (US); Steve J. Schmit, Bloomington, IN (US)

(73) Assignee: G.D.O., Inc., Elk River, MN (US)

( * ) Notice: Subject to any disclaimer, the term of this patent is extended or adjusted under 35 U.S.C. 154(b) by 1469 days.

(21) Appl. No.: 12/026,898

(22) Filed: Feb. 6, 2008

(65) Prior Publication Data

US 2012/0227876 A1 Sep. 13, 2012

Related U.S. Application Data

(63) Continuation-in-part of application No. 10/926,906, filed on Aug. 26, 2004, now abandoned.

(60) Provisional application No. 60/499,061, filed on Aug. 29, 2003.

(51) Int. Cl.

| | |
|---|---|
| ***C06B 45/00*** | (2006.01) |
| ***C06B 25/00*** | (2006.01) |
| ***C06B 25/34*** | (2006.01) |
| ***D03D 23/00*** | (2006.01) |
| ***D03D 43/00*** | (2006.01) |

(52) U.S. Cl.
USPC ..... 149/109.6; 149/2; 149/88; 149/92; 149/108.4; 149/109.4

(58) Field of Classification Search
USPC ..... 149/109.6, 2, 88, 92, 108.4, 109.4
See application file for complete search history.

(56) References Cited

U.S. PATENT DOCUMENTS

| | | | | |
|---|---|---|---|---|
| 4,909,868 | A * | 3/1990 | Melvin | 149/109.6 |
| 5,314,550 | A * | 5/1994 | Nahlovsky et al. | 149/109.6 |
| 6,080,907 | A * | 6/2000 | Miller | 588/319 |
| 6,777,586 | B1 * | 8/2004 | Arcuri et al. | 149/109.6 |
| 2005/0087273 | A1 * | 4/2005 | Arcuri et al. | 149/109.6 |

* cited by examiner

*Primary Examiner* — James McDonough
(74) *Attorney, Agent, or Firm* — Henry E. Naylor

(57) ABSTRACT

A process for recovering the energetic component from plastic bonded explosives. The process uses high velocity kinetic energy in the form of gases, liquids, or solids, alone or in combination, to cause the structural failure of the adhesive bonding between the polymer matrix and energetic component for the purpose of providing adequate loci for the solvation of the energetic component by appropriate solvents.

6 Claims, No Drawings

RECOVERY OF THE ENERGETIC COMPONENT FROM PLASTIC BONDED EXPLOSIVES

CROSS REFERENCE TO RELATED APPLICATIONS

This is a Continuation-in-Part of U.S. Ser. No. 10/926,906 filed Aug. 26, 2004 which is based on Provisional Application 60/499,061 filed Aug. 29, 2003.

FIELD OF THE INVENTION

The present invention relates to a process for recovering the energetic component from plastic bonded explosives. The process uses high velocity kinetic energy in the form of a fluid jet at a specific threshold pressure to cause the structural failure of the adhesive bonding between the polymer matrix and energetic component for the purpose of providing adequate loci for the solvation of the energetic component by appropriate solvents.

BACKGROUND OF THE INVENTION

Surplus munitions present a problem to the US military. Current budget constraints force the US military to prioritize its spending while effectively defending the interests of the United States. Defense budgets are further tightened because aging and surplus munitions must be guarded and stored. The US military regularly destroys a significant amount of its surplus munitions each year in order to meet its fiscal challenge. It also destroys a significant amount of munitions each year due to deterioration and obsolescence.

In the past, munitions stocks have been disposed of by open burn/open detonation (OBOD) methods—the most inexpensive and technologically simple disposal methods available. Although such methods can effectively destroy munitions, they fail to meet the challenge of minimizing waste by-products in a cost effective manner. Furthermore, such methods of disposal are undesirable from an environmental point of view because they contribute to the pollution of the environment. For example, OBOD technology produces relatively high levels of $NO_x$, acidic gases, particulates, and metal waste. Incomplete combustion products can also leach into the soil and contaminate ground water from the burning pits used for open burn methods. The surrounding soil and ground water must often be remediated after OBOD to meet environmental guidelines. Conventional incineration methods can also be used to destroy munitions, but they require a relatively large amount of fuel. They also produce a significant amount of gaseous effluent that must be treated to remove undesirable components before it can be released into the atmosphere. Thus, OBOD and incineration methods for disposing of munitions become impractical owing to increasingly stringent federal and state environmental protection regulations.

Various other incineration processes have been used to dispose of munitions including plasma arc, molten-metal/molten-salt baths, dilution in fuel stocks, and charge transfer complex oxidation technologies. These various other processes effectively destroy the excess munitions but fail to meet the $R^3$ challenge (recovery, reclamation, and reuse) of recovering energetic materials in a cost-effective manner to minimize waste generation. Further, destructive technologies prevent explosive component recovery and conversion of the excess munitions into unusable waste streams such as $CO_2$, $N_2$, and $NO_x$ stream, as well as solid waste streams.

Another disposal technology advanced to dispose of unwanted munitions utilizes the high temperatures generated in a plasma arc to decompose the munitions. This process avoids the problems of site remediation because it completely decomposes all chemical compounds in the plasma. Hypothetically, no partially decomposed compounds remain. Everything fed to the plasma chamber fully decomposes into oxidized gases such as $CO_2$, and $NO_x$. This process, however, is not only technically difficult and power intensive, but the plasma arc also creates many of the same gaseous waste problems as OB/OD. Unless excess oxygen is injected into the chamber, the plasma chamber will incompletely burn the munitions. The presence of excess combustion oxygen exacerbates the generation of nitrous oxides. The presence of chlorine or fluorine in the binders has the potential of generating dioxins or furans. In addition, the chambers cannot process loaded munitions due to the delicate nature of the refractories. Consequently, plasma arc technologies offer no cost or processing advantages over OB/OD with conventional munitions and work best for the destruction of extremely toxic or dangerous compounds such as chemical and biological weapons.

Further, today's even stricter environmental regulations require that new munitions and weapon system designs incorporate demilitarization processing issues. Increasingly stringent EPA regulations will not allow the use of OBOD or excessive incineration techniques, so new technologies must be developed to meet the new guidelines.

One type of munition that presents a unique problem for disposal are plastic bonded explosives (PBX) systems. Catalyzed high strength, resilient, and temperature tolerant polymer matrices are utilized by the military in both explosive ordnance as well as in propellants to provide ease in loading and to minimize separation and void formation of the energetic load. These high temperature, high strength, and impact resilient properties of the polymer matrices, which are valued to prevent void formation, are also the same properties that inhibit the efficient removal of the polymer bonded materials from the ordnance during recycling. The polymer materials are sufficiently resilient under normal situations to absorb the impact energy of kinetic removal methods, such as waterjet washout, without reaching the polymer's tensile strengths.

The original formulation of PBX consisted of RDX crystals bound within a polystyrene matrix. The polystyrene coating protected RDX crystals from the intense point stresses and friction experienced during manufacturing and handling, thus preventing premature detonation. This formulation also allowed casting the explosive mixture directly into a warhead. Several variations on the PBX concept arose from the original recipe, however, all formulations are similar in that they consist of an energetic component.

PBX is easily manufactured and can be cast or machined into complicated shapes or injected into small cavities. High mechanical strength, excellent explosive properties, excellent stability, high thermal input insensitivity, and relative insensitivity to handling make PBX the explosive material commonly used in modern weapons systems. The plastic components that give PBX its excellent properties, however, also create a demilitarization problem. For example it is difficult to dissolve these energetic particles that are completely coated in a high molecular weight cross-linked polymer matrix. Among the most popular polymers for PBX formulations are the polyurethanes.

The polyurethane coating on explosive particles in polyurethane-based PBX prevents the direct dissolution of the energetic, or explosive component. Various chemical demilitarization methods have been proposed but none of them have been successful for the recovery of PBX materials. Tompa, et al, (U.S. Pat. No. 4,389,265) and Spencer, et al, (U.S. Pat. No. 5,977,354) used heat to degrade the polymer. Hendry, et al, (U.S. Pat. No. 3,909,497) worked on developing polyurethanes that would preferentially degrade with heat. O'Neill, et al, (U.S. Pat. No. 4,018,636) tried water soluble polymers for PBX in order to aid in the demilitarization of the material. Shaw (U.S. Pat. No. 4,057,442) attempted to use swelling and depolymerizing chemicals to remove the plastic matrix while Heaton, et al, (U.S. Pat. No. 5,538,530) used humic acid and Phillips, et al, (U.S. Pat. No. 6,063,960) used nitric acid to attempt to degrade the polymer and dissolve the explosive. None of these systems have proven practical. Instead, they have proven problematic because they cause excessive degradation of the energetic component and are typically have safety issues because they require the use of excess heat that may lead to autoignition and detonation of the energetic component.

Also, U.S. Pat. Nos 5,363,603 and 5,737,709, which are incorporated herein by reference, teach the use of a fluid jet technology for cutting explosive shells and removing the explosive material, but they do not provide a method for recovering the energetic component, let alone a polymer coated energetic component.

While some of the above methods have met with varying degrees of success, there still remains a need in the art for improved methods and apparatus for demilitarizing plastic bonded explosives in an environmental, efficient and safe manner.

SUMMARY OF THE INVENTION

In accordance with the present invention there is provided a process for recovering the energetic component from a plastic bonded explosive comprised of an energetic component in a polymer matrix component, which process comprising:

a) comminuting said plastic bonded explosive by contacting said plastic bonded explosive with a jet of fluid having an effective energy to cause said plastic bonded explosive to be comminuted into particles of sufficiently small size to expose said energetic component, wherein the effective fluid pressure is at least that pressure, as expressed in MPa, which is calculated by multiplying the ultimate tensile strength of the polymer of the polymer matrix by 4.89;

b) contacting the plastic bonded explosive particles with a solvent in which the energetic component is soluble and in which the polymer matrix component is substantially insoluble, thereby forming a solution of energetic component in solvent and solid particles of polymer matrix component; and c) separating the energetic component solvent solution from the solid particles of polymer matrix component.

In a preferred embodiment the polymer matrix component is a polyurethane and the energetic component is cyclotrimethylenetrinitramine and the fluid jet pressure of 293 MPa.

Also in accordance with the present invention there is provided a process for separating the components of a plastic bonded explosive comprised of a polymer matrix component, an aluminum powder component, and an energetic component, which process comprises:

a) comminuting said plastic bonded explosive by contacting said plastic bonded explosive with a jet of water of an effective energy to cause said plastic bonded explosive to be comminuted into particles of sufficiently small size to effectively expose said energetic component and to free the aluminum powder particles from the polymer matrix component, wherein the effective water jet pressure is at least that pressure, as expressed in MPa, be calculated by multiplying the ultimate tensile strength of the polymer of the polymer matrix by 4.89;

b) separating said aluminum powder particles from the polymer matrix component and the energetic component;

c) contacting said polymer matrix component and energetic component with a solvent in which the energetic component is soluble but in which the polymer matrix component is substantially insoluble, thereby dissolving the energetic component in the solvent; and d) separating the energetic component solvent solution from the solid particles of polymer matrix component.

In a preferred embodiment of the present invention the plastic bonded explosive is contained in a munition casing of which the plastic bonded explosive is exposed for removal.

Also in accordance with the present invention there is provided a process for opening a munition containing a plastic bonded explosive comprised of an energetic component, an aluminum powder component, and a polymer matrix, wherein each component is recovered separately, which process comprising:

a) cutting open said munition by use of a high pressure fluid jet to expose the plastic bonded explosive;

b) comminuting said plastic bonded explosive by contacting said plastic bonded explosive with a jet of fluid an effective fluid pressure to cause said plastic bonded explosive to comminute into particles of sufficiently small size to expose said energetic component and to free the aluminum powder particles from the polymer component, wherein the effective fluid pressure is at least that pressure, as expressed in MPa, be calculated by multiplying the ultimate tensile strength of the polymer of the polymer matrix by 4.89;

c) separating said aluminum powder particles from the polymer component and the energetic component;

c) contacting said polymer component and energetic component with a solvent in which the energetic component is soluble but in which the polymer component is substantially insoluble, thereby dissolving the energetic component in the solvent; and e) separating the energetic component dissolved in solution from the polymer component.

DETAILED DESCRIPTION OF THE INVENTION

The present invention can be practiced on any plastic bonded explosive (PBX) material or munition or propellant containing PBX material. Plastic bonded explosives and composite propellants typically contain a particulate energetic component dispersed within a polymer matrix. The PBX material can also contain one or more additives, preferably aluminum powder. Non-limiting examples of polymers that are used as the matrix component in PBX materials include polyesters, polyurethanes, nylon molding compounds, polystyrenes, synthetic and natural rubbers, nitrocellulose, and fluorinated polymers. Some of the most common polymer components are those characterized as having ester or urea groups in its backbone. Non-limiting examples of such polymers include neoprenes, polyethylenes, polytetrafluroethylenes, polystyrenes, polychlorotrifluoroethylenes, polyvinylidenefluorides, polyurethanes, acetals, polycarbonates, polymethylmethacrylates, epoxides, polyethyleneteraphalates, polyesters, polyamides, and polyimides. Most common are the polyurethanes which are typically produced by the chemical reaction of an isocyante group from a diisocyanate and a hydroxyl group from a macrogylcol. Polyurethane forms when multifunctional molecules, such as diisocyanates and diols react with each other.

Non-limiting examples of energetic components that are found in PBX materials include cyclotrimethylenetrinitramine (RDX); cyclotetromethylene tetranitramine (HMX); hexanitrostilbene (HNS), 2,2-bis[(nitroxy)methyl]-1,3-propanediol dinitrate (PETN); ammonium perchlorate (AP); 2,4,6 trinitro-1,3 benzenediamine (DATB); ammonium picrate (Explosive D); nitrocellulose (NC); nitroguanidine (NQ); 4,5-trinitrophenol (TNP); hexahydro-1,3,5-benzenetriamine (TATB); N-methyl N-2,4,6 tetranitrobenzene (Tetryl); 2-methyl-1,3,5-trinitrobenzene (TNT); Amatol (Ammonium Nitrate/TNT); Baratol ($Ba(NO_3)_2$/TNT); black powder ($KNO_3$/S/C); Comp A (RDX/wax); Comp B (RDX/TNT); Comp C (RDX/plasticizer); Cyclotol (RDX/TNT); LOVA propellant; NACO propellant; any combination of the above materials; rocket propellant; and Octol (HMX/TNT). Other classes of energetics include fuels such as magnesium, aluminum, zirconium, titanium, bronze, sugars etc.; and oxidizers such as nitrates, chlorates, perchlorates, etc. Preferred are RDX, HMX, HNS, and PETN. More preferred are RDX and HMX.

In those cases where the PBX material to be treated is in a munition casing or shell, the munition can be opened by any suitable method. One preferred method for opening the munition is by fluid jet cutting, more preferably with a fluid jet containing an effective amount of abrasive material, such as garnet. Fluid jet technology will be described in more detail below since fluid jet technology is the preferred method for destroying the physical integrity of the PBX material. Intrinsic to the process of the present invention is the application of sufficient kinetic energy to cause failure of the polymer matrix component by physically shearing, tensile failure, or by vibrational excitation to failure. The failure of the polymer adhesive bonding to either the energetic (usually in crystalline form) or to one of the many additives used in explosive formulations, such as aluminum powder, allows exposed crystal surfaces to interact with a suitable solvent(s) to form an energetic in solvent solution. Once the solution is formed, the residual plastic matrix and other insoluble materials, which is now in particulate form, can be filtered off and the solution purified and the energetic recrystallized using conventional technologies employed during the manufacture of the energetic substance.

The inventors hereof have unexpectedly discovered that when a certain minimum threshold of fluid jet energy is delivered to a particular PBX material it will fracture in such a way that greatly enhances the downstream separation of polymeric material from the energetic material. The amount of energy required is dependent on the ultimate tensile strength (UTS) of the polymer material. The ultimate tensile strength being the maximum stress the polymer material can withstand before fracturing from the energetic component of the PBX material. It has unexpectedly been found by the inventor hereof that fluid pressure required of the waterjet to fracture the polymeric material from the energetic component is at least 4.89(UTS) in MPa. For example, for polyurethane having a UTS of 60 the waterjet will have to have at least a fluid pressure of 293 MPa.

After the physical integrity of the PBX material is sufficiently destroyed, the present invention utilizes chemical conversion that recovers substantially all of the components of a PBX material, or a PBX-containing munition, for potential reuse either in the military or commercial markets. Chemical conversion is an attractive alternative to destructive methods, such as OBOC, because it has the potential of recovering and converting substantially all the munition components into valuable chemical products with very little waste generation. This technically feasible, safe, and relatively inexpensive technology is capable of achieving the $R^3$ goals of demilitarization. The process of the present invention involves the removal of PBX explosive components from the munition casing, removal of protective coatings and binders (polymeric materials), the recovery of valuable energetic components for reuse, and the chemical conversion of non-reusable explosives and binders to valuable chemical products.

Once the physical integrity of the binding agent is effectively destroyed, the energetic component can be separated by filtration or purified by dissolution in a suitable solvent for further processing. Chemical binder decomposition techniques convert all components into valuable commodity chemicals with minimal waste generation. The process of the present invention uses conventional equipment and methods to treat these materials and require no secondary treatment of waste streams. Further, the process of the present invention is an improved method for the demilitarization of munitions because it is relatively safe, is economically competitive, and is typically environmentally friendly.

Conventional wisdom in the art assumed that high velocity jet washout of a polymer matrix, such as a polyurethane based PBX system, would require a secondary treatment by using a depolymerizing agent, such as monoethanolamine, to remove a sufficient amount of polyurethane. This would allow the subsequent use of a solvent to reach the energetic component with sufficient surface area necessary to dissolve the energetic component in a reasonable time period.

It has unexpectedly been found that by the practice of the present invention the physical integrity of a PBX material can be destroyed to such a degree that the adhesive bonding between polymer matrix and particulate energetic component becomes sufficiently disrupted to allow a substantial amount of the energetic component to become exposed, or even completely separated from the polymer matrix. This allows for either physical separation or solvation of the energetic component, or both. It has also been unexpectedly found that if the PBX material contains an additive, such as aluminum powder, the aluminum powder, after the destruction of the physical integrity of the PBX material, will be substantially freed from the polymer matrix component and can be physically separated from the remaining component(s) by simple filtering or washing and filtering techniques.

It is also within the scope of this invention to use a fluid other than water in the washout stage. The fluid can be from any class of fluid as long as it is capable of washing out the PBX material without having a deleterious affect on the components. Suitable fluids include both those that are used primarily for erosive purposes as well as those which have solvent properties, particularly having solvent properties with selectively with respect to the energetic component. Non-limiting examples of fluids that can be used as the fluid jet in the practice of the present invention include aliphatic hydrocarbons, such as naphtha and hexane; ketones, such as cyclohexanone and acetone; aromatic hydrocarbons, such as toluene and xylene; alcohols, such as ethanol and butanol; glycols, such as ethylene and propylene glycol; esters, such as ethyl acetate and n-butyl acetate; water; aqueous or non-aqueous mixtures of the above listed chemicals; gases that are liquified by pressure, such as propane, butane, and carbon dioxide; gases that are liquified by reduced temperature, such as propane, argon, and nitrogen; and liquified solids, such as microcrystalline wax and low temperature eutectic alloys. Water is the most preferred fluid. If the fluid chosen is a hydrocarbon or organic compound it is preferred that it be one in which the energetic material is at least partially soluble. In the case where the primary energetic component is RDX the preferred washout fluid, other than water, is acetone.

In one embodiment, the physical integrity of the PBX material is effectively destroyed by contacting it with a fluidjet having a certain minimum amount of energy depending on the ultimate tensile strength of the polymeric material. In order to use the waterjet to remove the PBX material from the ordnance it is necessary to repeatedly stress the polymeric matrix to failure in order to reduce it into small pieces. The primary size reduction is caused by kinetic impact of the high pressure fluid droplets against the polymer. The fluid "jet" breaks into discrete droplets after about 1000 orifice diameters and then acts as a multitude of individual high velocity impacts rather than a continuous stream of fluid. Initial fluid droplet impacts produce well-defined fracture patterns consisting of circular area free of damage surrounded by an annulus containing a dense array of fine short cracks together with a sparse distribution of deeper fractures initiated along the surface failures. Continued exposure to the high velocity fluidjet droplets produce crack growth and crack intersections at sites of fracture overlap. This process is followed by crevice growth as these fracture systems are enlarged by hydraulic penetration. An extensive network of subsurface fractures continue to be produced within the expanding cavities and with longer exposure pieces of the matrix fail into discrete pieces. This fracture process can only be accomplished when the pressure of the fluidjet is at a certain minimum depending on the ultimate tensile strength of the polymer, as previously been discussed. This certain minimum fluidjet pressure, in MPa, is determined by multiplying the ultimate tensile strength of the polymer material by 4.89. Once the pressure is calculated the minimum jet velocity in meters per second (m/s) can be calculated by use of the following formula:

$$V_{jet} = \sqrt{\frac{2P}{\rho}}$$

where

P=Stagnation pressure (Pa) of the fluid before the orifice

ρ=Density of the fluid ($kg \cdot m^{-3}$) at the orifice.

$V_{jet}$=Jet velocity (m·s-1) post-orifice.

This is the minimum fluidjet velocity that can be used for a given polymer material to fracture that polymer material in such a way that it is fracture into small particles and freed from the particulate energetic material. It the fluidjet velocity and pressure is below this certain minimum than the polymer material will not be effectively fractured and relatively large particles will be produced, which large particles will be comprised of polymeric material having energetic material trapped therein and not exposed for physical separation or removal by use of a solvent.

This jet of water strikes the PBX material with sufficient energy to cause the PBX material to comminute to an effectively small size that exposes the energetic component and substantially frees any aluminum powder present from the polymer matrix component. The preferred method for propelling the comminuting agent is by use of fluid jet technology and for removing the PBX material from its casing is the use of fluid jet washout technology at pressures that are effective to erode, or comminute, the PBX material. The preferred type of fluid jet washout equipment which is used in the practice of the present invention is described in U.S. Pat. No. 5,737,709 which is incorporated herein by reference. It is preferred that the fluid jet washout step of the present invention be able to achieve a 5× cleanliness that is required by Army Material Command Regulation 385-5 for explosives and Army Material Command Regulation 385-61 for chemical weapons. The preferred range of pressures can be used provided that the diameter of the washout stream is in the range of about 0.025 mm to about 0.5 mm.

If the PBX material to be treated is encased in a munition, the present invention can be practiced by first exposing the PBX material in the shell (munition) for removal. Typically this will be done by cutting open the metal shell by any suitable method known the art, preferably by use of a high pressure fluid jet. It is preferred that the shell be cut across its longitudinal axis at a point that would expose substantially all of the PBX material for removal. That is, an end of the shell. The PBX material can also be exposed by removing the fuze or fill plug of the shell, by cutting around the fuze or fill plug with a fluid jet, thereby exposing the PBX material. The exposed PBX material is then subjected to a pressured jet of suitable fluid that will preferably be delivered by a translationally mobile, rotating nozzle mounted at the end of a hollow lance. As the material is washed out of the shell it is collected in a collection vessel. The size of the comminuted PBX particles will vary somewhat depending on the fluid pressure of the fluid jet and the diameter of the orifice. Typical PBX particle sizes will range from about 6.5 mm to about 50 microns, preferably from about 50 microns to about 250 microns. Smaller particle sizes are more preferred because the higher surface area will expose a greater amount of the energetic component.

If the removed PBX particles still need to be further reduced in size a suitable particle reduction technique can be used. A preferred particle reduction technique that can be used for the practice of the present invention is use of a screen having the desired mesh positioned inside the collection vessel. The washout fluid and removed material can be passed through the screen before being passed from the washout area. The screen can be further positioned so that a back-facing ultra-high pressure washout jet impinges washed out material particles against the screen. In this way, washed out PBX particles that are small enough to pass through the screen do so. The size of the screen mesh is dictated by the maximum size of particles acceptable to the user. The practice of the instant invention is effective for a wide range of desired particle size, from hundredths of millimeters to tens of centimeters.

The following examples are presented for illustrative purposes and are not to be considered limiting the present invention in any way.

Example 1

The following test was performed using billets of PBXN-109. The exact chemistry of the PBXN-109 sample was not known but it is believed to approximate the formula given in the military specification for PBXN-109 which is shown in Table 1.

TABLE 1

PBXN-109 Formulation

| Ingredients Percent (by weight) | Nominal | Min | Max |
|---|---|---|---|
| Sym-Cyclotrimethylene trinitramine (RDX) Type II Class 1 | 64.00 | 56.5 | 65.5 |
| Type II Class 5 | 0.00 | 0.0 | 7.0 |
| Aluminum Powder, Spherical, Type IV | 20.00 | 18.00 | 22.00 |
| Polybutadiene, Liquid, | 7.346 | 7.0 | 7.5 |

TABLE 1-continued

| PBXN-109 Formulation | | | |
|---|---|---|---|
| Ingredients Percent (by weight) | Nominal | Min | Max |
| Hydroxyl-Terminated, Type II (PolyBD) | | | |
| Di (2-ethylhexyl) adipate (DOA) | 7.346 | 7.0 | 7.5 |
| 2,2'-methylenebis (4-methyl-6-tertiarybutyl Phenol) antioxidant | 0.10 | 0.09 | 0.11 |
| N,N2-Hydroxyethyl dimethyl-hydantoin (DHE) | 0.26 | 0.25 | 0.27 |
| Triphenylbismuth (TPB) (Dibutyltin dilaurate (DBTL)) | 0.02 | 0.015 | 0.045 |
| Isophorone Diisocyanate (IPDI) | 0.9465 | | |

The two individual constituents of the PBX mixture that are of most interest for the analytical work on the materials removed from a surrogate warhead are the RDX energetic and the aluminum metal powder. The RDX was in the form of orthorhombic crystals and has crystal faces were approximately rectangles. The physical size of the RDX particles is will fall within a certain set of sieve sizes, shown in Table 2 below.

TABLE 2

| RDX Particle Sizes | | | |
|---|---|---|---|
| Mesh Size | Class 1 | Class 5 | Microns |
| 20 | 98 ± 2 | | 841 |
| 50 | 90 ± 10 | | 297 |
| 100 | 60 ± 30 | | 149 |
| 200 | 25 ± 20 | | 74 |
| 325 | | 97 min | 44 |

The data from Table 2 indicates that the mean RDX particle size lies between about 80 and 120 microns. The military specifications for spherical aluminum powder show that the average aluminum particle size is between 11 and 27 microns in size The PBX loaded surrogate warhead was washed out using high velocity (800 m/s) water which flowed into the leach tank. Inside the leach tank was a 100 micron stainless steel filter that retained bulk material but allowed finer material to pass through to the aluminum filter vessel below. Inside the aluminum filter vessel was a 5 micron polypropylene sock to filter particulate materials out of the liquid stream. After the majority of the RDX had been leached out of the polyurethane matrix component with use of an acetone rinse a decomposition of the polyurethane matrix material was accomplished using monoethanolamine. After the MEA had been washed off, the remaining particles were sampled for analysis.

The results of the PBX leaching and decomposition tests showed that nitramine (RDX) could be successfully dissolved from the washed out PBX-109 material using acetone. The solvent leaching showed RDX being recovered directly from the polymer matrix prior to depolymerization by MEA. The results of the first and second leachings are shown in Tables 3 and 4 respectively.

TABLE 3

| Results of First Solvent Leaching | |
|---|---|
| Sample Number | Mass % RDX |
| AD | 3.88% |
| AE | 10.37% |

TABLE 3-continued

| Results of First Solvent Leaching | |
|---|---|
| Sample Number | Mass % RDX |
| AF | 7.75% |
| AG | 7.06% |
| AH | 6.95% |
| AI | 7.38% |
| AJ | 8.89% |
| AK | 7.45% |
| AL | 8.57% |
| AM | 9.18% |

TABLE 4

| Results of Second Leaching | |
|---|---|
| Sample Number | Mass % RDX |
| AO | 1.10% |
| AQ | 0.96% |
| AR | 0.71% |
| AS | 1.13% |
| AT | 1.18% |
| AU | 0.81% |
| AV | 0.84% |
| AW | 1.16% |
| AX | 0.94% |

The above data in the above two tables is as a function of time and taken 7.5+/−2.5 minutes). This date evidences that use of a waterjet to destroy the physical integrity of the PBX material has done such a good job in tearing apart the PBX that the RDX is readily solvated by the acetone i.e. after the first period of time (~10 minutes) the leaching process has equilibrated.

The average mass fraction of RDX in the acetone was 7.76% for the first leach and 0.98% for the second leach. At the beginning of the first leach, problems with the leach tank mixer drive resulted in an almost a two hour time gap between samples. After the two hour period, however, the RDX concentration in the acetone takes a significant and expected jump. Subsequent heating appears to have had little effect on the RDX concentration in the acetone.

The RDX concentration in acetone of the second leach shows a significant decrease when compared to the first leach, an average RDX mass fraction of 0.98% as opposed to the 7.76% seen in the first leach. Thus, it appears that the first leach extracted a majority of the RDX. To verify that the leach process worked properly, a sample of the remaining material in the leach tank was once again leached in the laboratory at 40° C. for 4 hours. High Performance Liquid Chromatography (HPLC) analysis of the acetone revealed only a trace amount of RDX.

Consequently it is shown that the velocity of the kinetic energy polymer disrupter was the critical factor in breaking up the plastic matrix and that this kinetic energy could be applied by a gas, liquid, or solid alone or in combination. Such materials that could be used could be jets of fluids or gases, high velocity particle streams of solids, combinations of particle streams and jet streams comprised of solids and liquids or solids and gases, or combinations of solids, liquids, and gases. Methods that can be used to accelerate materials to such velocities are required. Such methods include expansion through an orifice (such as high pressure gas or liquid), explosive discharge (such as capacitive discharge or exploding bridgewire), linear accelerator, rotational (centrifugal) force, magnetic repulsion, piezoelectric drivers, or by other mechanical means.

Example 2

The HTPB polymer based PBX had a hardness of approximately Shore A hardness of 56.3 (+/−2.0), typical of midrange hardness polyurethanes. The minimum hardness required by military specification is Shore-A of 30. The Shore-A hardness measured is determined by the inverse penetration of a 1.25 mm diameter 35-degree truncated steel cone under 9.8 N (1000 grams) as described under ASTM D2240. A Shore-A hardness of zero is given for full 2.54 mm (0.1 in) penetration of the cone while a hardness of 100 is given for zero penetration. The modulus of elasticity for the PBX tested was approximately 7.6 MPa at 23° C.

Tests were performed at a range of waterjet velocities by adjusting the input pressure to the orifice. Tests were performed using an Ingersoll-Rand waterjet intensifier and a 0.25 mm (0.010 in) precision orifice flowing approximately 0.32 liter/s (0.5 gal/min). Actual flow rates varied slightly with pressure due to the compressibility of water. Feed rate was controlled by a CNC gantry table at 0.25 mm/s (0.6 inch/min). The water pressure was varied and the material washed out was collected as shown in Table 5.

TABLE 5

Waterjet Tests Against HTPB-based Polymer

| Water Pressure | | Velocity | Mat'l Removed |
|---|---|---|---|
| MPa | ksi | m/s | in 60 s ($cm^3$) |
| 103 | 15 | 460 | 13.9 |
| 172 | 25 | 600 | 25.2 |
| 241 | 35 | 700 | 34.5 |
| 276 | 40 | 750 | 45.3 |
| 293 | 42.5 | 775 | 62.0 |
| 310 | 45 | 800 | 79.8 |
| 328 | 47.5 | 820 | 94.7 |
| 345 | 50 | 840 | 125.1 |

There was a significant higher washout rate of the HTPB-binder when the waterjet system operated above 293 MPa (42.5 ksi). Particle size analysis showed that the particles were significantly smaller when washed out at the higher pressures. The smaller particle size was significant in downstream solvent extraction processing since it allowed for more access to the solvent and faster processing. The following Table 6 is the calculated threshold impact velocities, was well as the requisite water pressures for a list of polymers that are commonly found in military ordnance and projectiles.

TABLE 6

| | | | Predicted "Knee" and Desirable Operating Water | |
|---|---|---|---|---|
| Polymer | Density g $cm^{-3}$ | UTS (MPa) | Velocity (m/s) | Pressure (MPa) |
| Neoprene | 1.55 | 10 | 313 | 49 |
| Polyethylene | 0.92 | 14 | 371 | 69 |
| Polytetrafluroethlene | 2.25 | 27 | 515 | 132 |
| Polystryene | 1.04 | 28 | 524 | 137 |
| Polychlorotri-fluoroethylene | 2.10 | 39 | 619 | 191 |

TABLE 6-continued

| | | | Predicted "Knee" and Desirable Operating Water | |
|---|---|---|---|---|
| Polymer | Density g $cm^{-3}$ | UTS (MPa) | Velocity (m/s) | Pressure (MPa) |
| Polyvinylidenefluroide | 1.77 | 43 | 650 | 211 |
| Polyurethane | 0.99 | 60 | 768 | 293 |
| Acetal | 141 | 66 | 805 | 323 |
| Polycarbonate | 1.20 | 66 | 805 | 323 |

What is claimed is:

1. A process for recovering the energetic component from a plastic bonded explosive comprised of an energetic component in a polymer matrix component, which process comprising:

a) comminuting said plastic bonded explosive by contacting said plastic bonded explosive with a high pressure jet of water of an effective water pressure to cause said plastic bonded explosive to be comminuted into particles of a size ranging from about 6.5 mm to about 50 microns to expose said energetic component, wherein the effective water pressure is at least that pressure, as expressed in MPa, be calculated by multiplying the ultimate tensile strength of the polymer of the polymer matrix by 4.89;

b) contacting the plastic bonded explosive particles with a solvent in which the energetic component is soluble and in which the polymer matrix component is substantially insoluble, thereby forming a solution of energetic component in solvent and solid particles of polymer matrix component; and c) separating the energetic component solvent solution from the solid particles of polymer matrix component.

2. The process of claim 1 wherein the polymer of the polymer matrix is selected from the group consisting of neoprenes, polyethylenes, polytetrafluoroethylenes, polystyrenes, polychlorotrifluoroethylenes, polyvinylidenefluorides, polyurethanes, acetals, polycarbonates, polymethylmethacrylates, epoxides, polyethyleneteraphalates, polyesters, polyamides, and polyimides.

3. The process of claim 1 the energetic component is selected from the group consisting of cyclotrimethylenetrinitramine, cyclotetromethylene tetranitramine, hexanitrostilbene, 2,2-bis[(nitroxy) methyl]-1,3-propanediol dinitrate, ammonium perchlorate, 2,4,6 trinitro-1,3 benzenediamine, ammonium picrate, nitrocellulose, nitroguanidine, 4,5-trinitrophenol, hexahydro-1,3,5-benzenetriamine, N-methyl N-2, 4,6 tetranitrobenzene, 2-methyl-1,3,5-trinitrobenzene, a mixture of ammonium nitrate and 1,3,5-trinitrobenzene; a mixture of $Ba(NO_3)_2$ and 1,3,5-trinitrobenzene, black powder ($KNO_3$/S/C), Composition B, Composition C, a mixture of cyclotrimethylenetrinitramine and 1,3,5-trinitrobenzene, LOVA propellant, NACO propellant, and Octol.

4. The process of claim 3 wherein the energetic component is selected from the group consisting of cyclotrimethylenetrinitramine, cyclotetromethylene tetranitramine, hexanitrostilbene, and 2,2-bis[(nitroxy) methyl]-1,3-propanediol dinitrate.

5. The process of claim 4 wherein the energetic component is cyclotrimethylenetrinitramine.

6. The process of claim 1 wherein the particle size of the comminuted particles is from about 50 microns to about 250 microns.

* * * * *